US008362915B2

(12) United States Patent
Mehta et al.

(10) Patent No.: US 8,362,915 B2
(45) Date of Patent: Jan. 29, 2013

(54) SYSTEM AND METHOD FOR DETERMINING STRETCH OR COMPRESSION OF A DRILL STRING

(75) Inventors: Shyam Mehta, Missouri City, TX (US); Georgiy Bordakov, Richmond, TX (US)

(73) Assignee: Intelliserv, LLC, Houston, TX (US)

( * ) Notice: Subject to any disclaimer, the term of this patent is extended or adjusted under 35 U.S.C. 154(b) by 500 days.

(21) Appl. No.: 12/609,589

(22) Filed: Oct. 30, 2009

(65) Prior Publication Data

US 2011/0102188 A1 May 5, 2011

(51) Int. Cl.
*G01V 3/00* (2006.01)

(52) U.S. Cl. ..... 340/854.1; 175/24; 175/40; 175/51; 175/90; 175/106; 702/6; 702/9

(58) Field of Classification Search ..... 340/854.1; 175/24, 40, 106, 51, 90; 702/6, 9
See application file for complete search history.

(56) References Cited

U.S. PATENT DOCUMENTS

| | | | | |
|---|---|---|---|---|
| 6,745,854 | B2 * | 6/2004 | Bloom et al. | 175/51 |
| 6,938,708 | B2 * | 9/2005 | Bloom et al. | 175/51 |
| 7,185,716 | B2 * | 3/2007 | Bloom et al. | 175/51 |
| 7,857,780 | B2 * | 12/2010 | Sommers et al. | 602/36 |
| 2009/0059722 | A1 | 3/2009 | Priest | |
| 2009/0260876 | A1 | 10/2009 | Gleitman | |
| 2010/0307742 | A1 * | 12/2010 | Phillips et al. | 166/250.01 |

FOREIGN PATENT DOCUMENTS

| | | | |
|---|---|---|---|
| WO | 2005033473 | A1 | 4/2005 |
| WO | 2009064728 | A1 | 5/2009 |

OTHER PUBLICATIONS

International Application No. PCT/US2010/048434 Search Report and Written Opinion dated May 9, 2011.

* cited by examiner

*Primary Examiner* — Lam T Mai
(74) *Attorney, Agent, or Firm* — Conley Rose, P.C.

(57) ABSTRACT

A system and a method for determining stretch or compression of a drill string is disclosed. Sensors are positioned along the drill string for collecting data for determining the stretch or compression. The stretch or the compression of the drill string may be used to calculate depths at which measurements are obtained by tools associated with the drill string.

19 Claims, 4 Drawing Sheets

SYSTEM AND METHOD FOR DETERMINING STRETCH OR COMPRESSION OF A DRILL STRING

BACKGROUND OF THE INVENTION

The present invention generally relates to a system and a method for determining stretch or compression of a drill string. Sensors may be positioned along the drill string to obtain data related to stretch/compression of the drill string. The stretch/compression of the drill string may be used to calculate depths at which measurements are obtained by tools associated with the drill string.

To obtain hydrocarbons, a drilling tool is driven into the ground surface to create a borehole through which the hydrocarbons are extracted. Typically, a drill string is suspended within the borehole. The drill string has a drill bit at a lower end of the drill string. The drill string extends from the surface to the drill bit. The drill string has a bottom hole assembly (BHA) located proximate to the drill bit.

Drilling operations typically require monitoring to determine the trajectory of the borehole. Measurements of drilling conditions, such as, for example, drift of the drill bit, inclination and azimuth, may be necessary for determination of the trajectory of the borehole, especially for directional drilling. As a further example, the measurements of drilling conditions may be information regarding the borehole and/or a formation surrounding the borehole. The BHA may have tools that may generate and/or may obtain the measurements. The measurements may be used to predict downhole conditions and make decisions concerning drilling operations. Such decisions may involve well planning, well targeting, well completions, operating levels, production rates and other operations and/or conditions. Moreover, the measurements are typically used to determine when to drill new wells, re-complete existing wells, case wells, or alter wellbore production.

The tools obtain the measurements and associate the measurements with corresponding times. For example, a computer periodically calculates and records depths of the drill bit and associates a time with each depth of the drill bit. Thus, when the tools are retrieved from the borehole, the tools may transfer the measurements and the corresponding time data to the computer. The computer may use the times to associate the measurements with corresponding depths of the tools or sensors. The computer may generate a log of the measurements as a function of the depth of the drill bit.

Technology for transmitting information from the tools while the tools are located within the borehole, known as telemetry technology, is used to transmit the measurements from the tools of the BHA to the surface for analysis. At present, mud pulse telemetry is the only technique in widespread commercial use for communication while drilling, between downhole equipment and the surface (unless otherwise indicated, references herein to "while drilling" or the like are intended to mean that the drill string is in the borehole or partially in the borehole as part of an overall drilling operation including drilling, pausing, and/or tripping, and not necessarily that a drill bit is rotating).

In mud pulse telemetry, data is transmitted as pressure pulses in the drilling fluid. However, mud pulse telemetry has well-known limitations, including relatively slow communication, low data rates and marginal reliability. In many cases, this rate is insufficient to send all of the data that is gathered by an LWD tool string, or is limiting on the configuration of a desired tool string. Also, mud pulse technology does not work well in extended reach boreholes. Signaling from uphole to downhole by regulating mud pump flow, to control processes such as directional drilling and tool functions, is also slow and has a very low information rate. Also, under some circumstances, such as, for example, underbalanced drilling employing gases or foamed drilling fluid, current mud pulse telemetry cannot function.

There have been various attempts to develop alternatives to mud pulse telemetry that are faster, have higher data rates and do not require the presence of a particular type of drilling fluid. For example, acoustic telemetry which transmits acoustic waves through the drill string has been proposed. Data rates of acoustic telemetry are estimated to be approximately an order of magnitude higher than data rates of mud pulse telemetry, but are still limiting. Further, noise is a problem for acoustic telemetry. Another example is electromagnetic telemetry that uses electromagnetic waves transmitted through the earth. Electromagnetic telemetry is considered to have limited range and also has limited data rates. In addition, electromagnetic telemetry depends on characteristics, such as, for example, resistivity, of the formations surrounding the borehole.

The placement of wires in drill pipes for carrying signals has been proposed. Some early approaches to a wired drill string are disclosed in U.S. Pat. No. 4,126,848; U.S. Pat. No. 3,957,118; U.S. Pat. No. 3,807,502; and the publication "Four Different Systems Used for MWD," W. J. McDonald, The Oil and Gas Journal, pages 115-124, Apr. 3, 1978.

The idea of using inductive couplers located at the pipe joints has also been proposed. The following disclose use of inductive couplers in a drill string: U.S. Pat. No. 4,605,268; Russian Federation published patent application 2140527, filed Dec. 18, 1997; Russian Federation published patent application 2040691, filed Feb. 14, 1992; and WO Publication 90/14497A2. Also see: U.S. Pat. No. 5,052,941; U.S. Pat. No. 4,806,928; U.S. Pat. No. 4,901,069; U.S. Pat. No. 5,531,592; U.S. Pat. No. 5,278,550; and U.S. Pat. No. 5,971,072.

U.S. Pat. Nos. 6,641,434 and 6,866,306 to Boyle et al., both assigned to the assignee of the present application and incorporated by reference in their entirety, describe a wired drill pipe joint that is a significant advance in the wired drill pipe art for reliably transmitting measurement data in high-data rates, bidirectionally, between a surface station and locations in the borehole. The '434 and '306 patents disclose a low-loss wired pipe joint in which conductive layers reduce signal energy losses over the length of the drill string by reducing resistive losses and flux losses at each inductive coupler. The wired pipe joint is robust in that the wired pipe joint remains operational in the presence of gaps in the conductive layer. Advances in the drill string telemetry art provide opportunity for innovation where prior shortcomings of range, speed, and data rate have previously been limiting on system performance.

More specifically, during the drilling phase of the construction of the wellbore, the length of the drill string in the borehole is used to estimate the depths or the along-hole lengths of a borehole based on an assumption that the drill pipe is inelastic and does not stretch. However, the assumption that the drill string is inelastic is not valid. The drill string stretches or compresses at various positions and is a function of several parameters, such as, for example, temperature, pressure and stress. The assumption that the drill string is inelastic may not yield sufficient accuracies for any number of reasons, such as formation testing or formation sampling.

Modeling, such as, for example, "torque and drag" modeling, attempts to compensate for the elasticity of the drill string. "Torque and drag" modeling is a complex modeling technique which involves modeling the interaction of the drill string and the borehole wall and modeling of bit behavior.

Modeling is based on other assumptions regarding the drill string and the borehole that may lead to inaccuracies in data. For example, modeling does not account for friction on the individual pipe sections due to torturocity of the wellbore because the modeling is based on static surveys. Friction will translate into additional compressional forces on some pipe sections and not on other pipe sections even though these pipe sections may be adjacent to each other. Thus, the modeling will assign the same stress to both adjacent pipe sections even though the adjacent pipe sections may have different stress.

DETAILED DESCRIPTION OF THE PRESENTLY PREFERRED EMBODIMENTS

The present invention generally relates to a system and a method for determining stretch or compression of a drill string. More specifically, the present invention relates to sensors positioned along the drill string that may be used to determine stretch/compression of the drill string. Information relating to the stretch/compression may be used to calculate actual depths at which measurements are obtained by downhole tools associated with the drill string. For example, the stress on the drill string due to the buoyant drill string weight, the weight-on-bit and frictional forces from contact with the borehole may be used to calculate the depths and/or corrections for the depths. The frictional forces and the weight-on-bit may vary depending on the rig operation and user input at a surface location. The corrected depths may be associated with measurements obtained by downhole tools.

Figure 1:
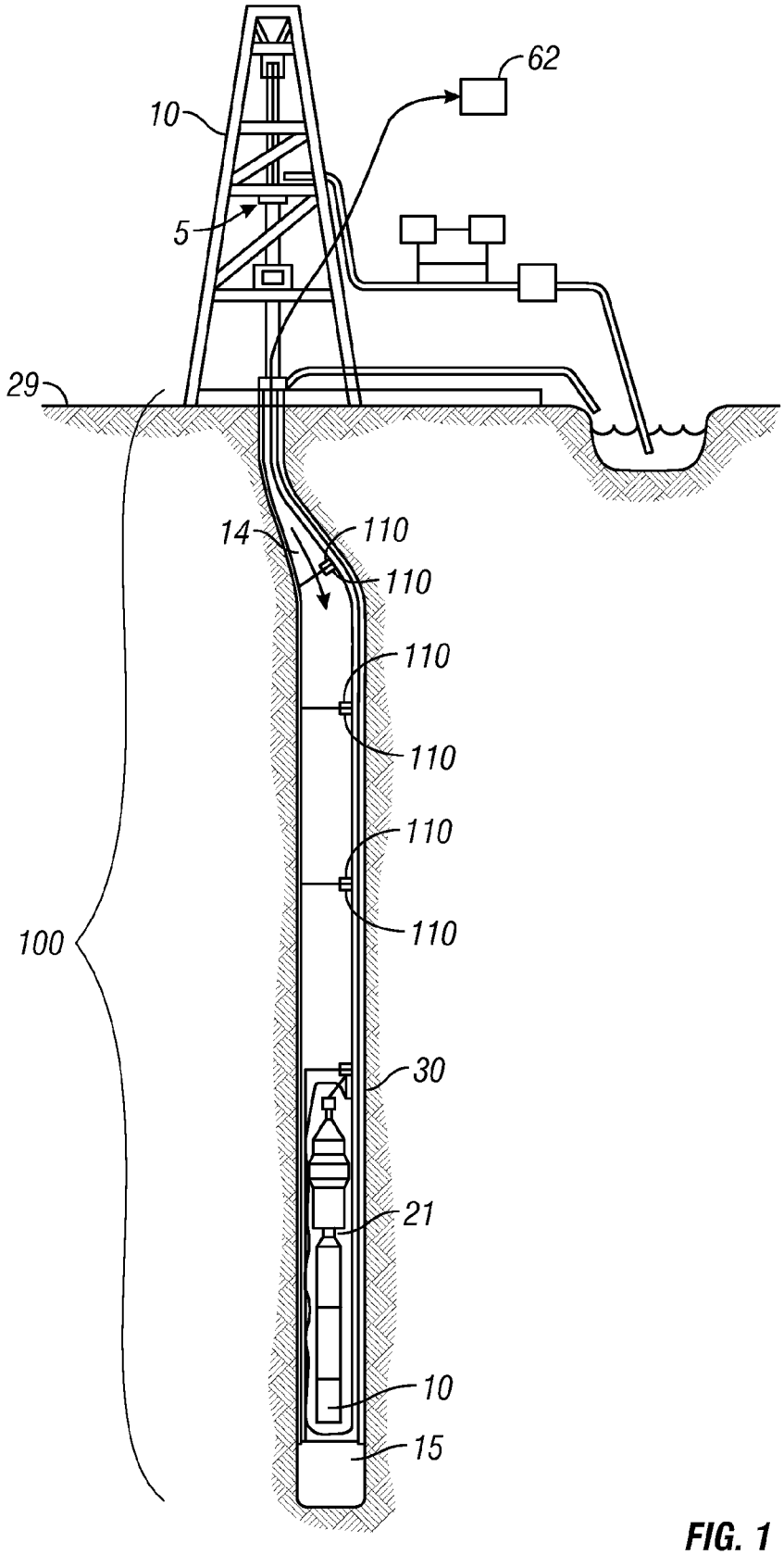
FIG. 1 illustrates a drill string in an embodiment of the present invention.

Referring now to the drawings wherein like numerals refer to like parts, FIG. 1 generally illustrates a borehole 30 that may penetrate a drilling surface in an embodiment of the present invention. A platform assembly 10 may be located at a surface location 29. The platform assembly 10 may be positioned over the borehole 30. A drill string 14 may be suspended within the borehole 30 by a hook 5 connected to the platform assembly 10. The drill string 14 may have a drill bit 15 and/or a bottom hole assembly 21 (hereafter "the BHA 21") that may be located adjacent to the drill bit 15. The drill bit 15 may be rotated by imparting rotation on the drill string 14, and/or a motor or other device (not shown) may be provided with the drill string 14 to rotate the drill bit 15.

One or more tools 10 may be associated with the BHA 21 and/or the drill string 14. The tools 10 may provide measurements regarding the borehole 30, a formation that may surround the borehole 30, the drill string 14 and/or any component of the drill string 14. For example, one or more of the tools 10 may be and/or may have a measurement-while-drilling ("MWD") tool, a logging-while-drilling ("LWD") tool, a strain measuring device, a torque measuring device, a temperature measuring device, a seismic tool, a resistivity tool, a direction measuring device, an inclination measuring device, a weight-on-bit measuring device, a vibration measuring device, a shock measuring device, a stick-slip measuring device, a drilling tool used to create the borehole 30 and/or the like.

In an embodiment, one or more of the tools 10 may be a wireline configurable tool, such as a tool commonly conveyed by wireline cable as known to one having ordinary skill in the art. In an embodiment, one or more of the tools 10 may be a well completion tool that may extract, may sample and/or may control drilling fluid. In an embodiment, one or more of the tools 10 may be a steering mechanism that may control a direction of drilling, the rotation of the drill string 14, an inclination of the borehole 30 and/or an azimuth of the borehole 30. The present invention is not limited to a specific embodiment of the tools 10. FIG. 1 depicts the tools 10 in association with the BHA 21, but the present invention is not limited to a specific location of the tools 10 within the drill string 14.

The drill string 14 may be, may have and/or may be associated with wired drill pipe 100 that may consist of one or more wired drill pipe joints 110 (hereafter "the WDP joints 110"). The WDP joints 110 may be interconnected to form the drill string 14. The wired drill pipe 100 and/or the WDP joints 110 may enable the tools 10 to communicate with the surface location 29. Examples of wired drill pipe and WDP joints that may be used in the wired drill pipe 100 is described in detail in U.S. Pat. Nos. 6,641,434 to Boyle et al. and 7,413,021 to Madhavan et al. and U.S. Patent App. Pub. No. 2009/0166087 to Braden et al., herein incorporated by reference in their entireties. The present invention is not limited to a specific embodiment of the wired drill pipe 100 and/or the WDP joints 110. The wired drill pipe 100 may be any system that may enable the tools 10 to communicate with the surface location 29 as known to one having ordinary skill in the art. While the disclosed embodiments refer to the drill string 14 as being wired drill pipe, it will be appreciated by a person having ordinary skill in the art that any type and/combination of telemetries may be used. The present invention is not limited to wired drill pipe.

For example, the wired drill pipe 100 may be a portion of a hybrid telemetry system such that other telemetry technology may be used with the wired drill pipe 100. The wired drill pipe 100 may extend from the surface location 29 to a position within the borehole 30, and a mud pulse telemetry system (not shown) may extend from the position within the borehole 30 to the BHA 21. The present invention is not limited to a specific embodiment of the hybrid telemetry system. The other telemetry technology may be any telemetry system that may be coupled with the wired drill pipe 100 to enable the tools 10 to communicate with the surface location 29. The present invention is not limited to a specific number of telemetry systems, and the tools 10 may use any number of telemetry systems to communicate with the surface location 29.

The wired drill pipe 100 may be connected to a terminal 62. The terminal 62 may be, for example, a processor, a desktop computer, a laptop computer, a personal digital assistant ("PDA"), an internet protocol (hereinafter "IP") video cellular device, an ALL-IP electronic device and/or a device capable of receiving, manipulating, analyzing and/or displaying data. The terminal 62 may be located at the surface location 29 and/or may be remote relative to the borehole 30. In an embodiment, the terminal 62 may be located downhole such that the terminal 62 may be located within the borehole 30. The present invention is not limited to a specific embodiment of the terminal 62, and the terminal 62 may be any device that has a capability to communicate with the tools 10 using the wired drill pipe 100. Any number of terminals may be connected to the wired drill pipe 100, and the present invention is not limited to a specific number of terminals.

The tools 10 may have capabilities for measuring, processing and/or storing information. The tools 10 may have and/or may be a sensor, such as, for example, a gauge, a temperature sensor, a pressure sensor, a stress or strain sensor to measure stretch or compression of the drill string 14, a frictional sensor, a flow rate measurement device, an oil/water/gas ratio measurement device, a scale detector, a vibration sensor, a sand detection sensor, a water detection sensor, a viscosity sensor, a density sensor, a bubble point sensor, a composition sensor, a resistivity array sensor, an acoustic sensor, a near infrared sensor, a gamma ray detector, a $H_2S$ detector, a $CO_2$ detector and/or the like.

For example, the tools 10 may measure, may record and/or may transmit data acquired from and/or through the borehole 30 (hereinafter "the data"). The data may relate to the borehole 30 and/or the formation that may surround the borehole 30. For example, the data may relate to one or more characteristics of the formation and/or the borehole 30, such as, for example, a temperature, a pressure, a depth, a composition, a density and/or the like. The data may relate to one or more characteristics of the drill string 14, such as, for example, a temperature, a pressure, an amount of stretch, an amount of compression, a force on the drill string, an amount of strain, an angle, a direction, a characteristic of fluid flowing through the drill string 14, a dog-leg severity and/or the like. The data may indicate, for example, a depth of the borehole 30, a width of the borehole 30 and/or the like. Further, the data may indicate, for example, a location of the drill bit 15, an orientation of the drill bit 15, a weight applied to the drill bit 15, a rate of penetration, properties of an earth formation being drilled, properties of an earth formation and/or a hydrocarbon reservoir located proximate to the drill bit 15, fluid conditions, fluids collected and/or the like. Still further, the data may be, for example, resistivity measurements, neutron porosity measurements, azimuthal gamma ray measurements, density measurements, elemental capture spectroscopy measurements, neutron gamma density measurements that measure gamma rays generated from neutron formation interactions, sigma measurements and/or the like. In addition, the data may indicate annular pressure, three-axis shock and/or vibration, for example.

In a preferred embodiment, the data may indicate a trajectory, an inclination and/or an azimuth of the borehole 30. The data may be measured and/or may be obtained at predetermined time intervals, at predetermined depths, at request by a user and/or the like. The present invention is not limited to a specific embodiment of the data.

The tools 10 may transmit the data in association with corresponding times. For example, the wired drill pipe 100 may transmit a portion of the data in association with a corresponding timestamp or depth. The corresponding timestamp may be provided by an internal clock of one or more of the tools 10 that obtained the portion of the data. Alternatively, the terminal 62 may determine the corresponding timestamp for the portion of the data. For example, the corresponding timestamp may be determined using an internal clock of the terminal 62. The internal clock of the one or more of the tools 10 may be synchronized with the internal clock of the terminal 62.

Figure 2:
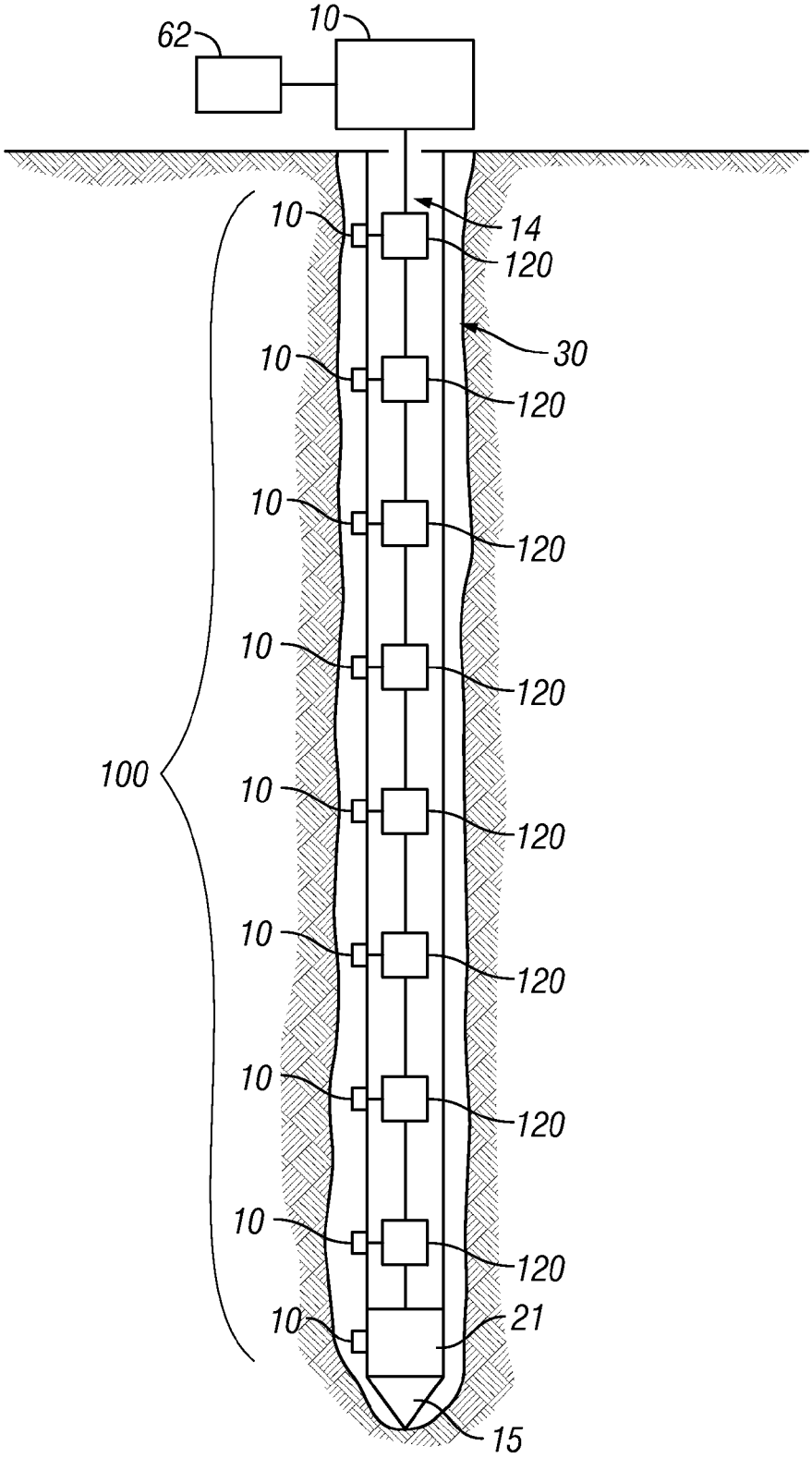
FIG. 2 illustrates wired drill pipe in an embodiment of the present invention.

As shown in FIG. 2, the wired drill pipe 100 may have sensors 120 for collecting the data along the drill string 14. Although FIG. 1 illustrates the sensors 120 located adjacent the pipe joints, the sensors 120 may be located at any position along the drill string 14. The sensors 120 may be one or more of the tools 10 and/or any device capable of measuring a characteristic of the formation, drill string 14 and/or the borehole 30. The sensors 120 may collect the data related to the stretch/compression or temperature of the drill string 14. The sensors 120 may collect raw data that may be used to calculate the stretch/compression. The sensors 120 may have a processor or other device capable of analyzing and/or processing the data to determine the stretch/compression of the drill string 14. Accordingly, the sensors 120 may transmit raw data or processed data to the surface.

The sensors 120 and/or the terminal 62 may model the data, such as representing the drill string 14 as a series of elastic tubular components in between measuring points. The data may be used to calculate the overall length of the drill string 14, the length between the sensors 120, an actual position of the sensor 120, a position of one of the tools 10 or other position/location as will be appreciated by a person having ordinary skill in the art. For example, the data may be model or analyzed using methods of the Strength of Material (Timoshenko, S. P. and D. H. Young, Elements of Strength of Materials, $5^{th}$ Edition). A person of ordinary skill in the art will appreciate that other models and methods of analyzing the data may be used, such as computational packages and methods used in construction mechanics. The modeling may be free of assumptions behind "torque and drag" and, as a result, may provide more accurate stress and temperature measurements along the drill string 14.

To improve accuracy, the data collected by the sensors 120 may be collected continuously. The data may be averaged by any technique known to a person having ordinary skill in the art. The data may be provide to the terminal 62 to provide real-time analysis.

In an embodiment, the sensors 120 may be incorporated into repeaters for amplifying signals transmitted by the wired drill pipe 100. Hereinafter use of "the repeaters 120" refers to the sensors 120 incorporated into the repeaters, and it should be understood that use of "the sensors 120" includes embodiments with and without a sensor or tool being incorporated into a repeater. Each of the repeaters 120 may be housed in different sections of the wired drill pipe 100. The repeaters 120 may receive the signals, may amplify the signals and may broadcast amplified signals. For example, each of the repeaters 120 may transmit the amplified signals to an adjacent one of the repeaters 120. The repeaters 120 may increase transmission range of the signals. The repeaters 120 of the wired drill pipe 100 may be located at intervals between the drill bit 15 and the surface.

Each of the repeaters 120 may have electronic circuitry and/or a power source, such as, for example, a battery. Availability of power from the power source of the repeaters 120 may enable association of the tools 10 with the repeaters 120. For example, a subset of the sensors 120 may be physically connected to the repeaters 120. Thus, the repeaters 120 may perform both repeater functions and measurement functions. Each of the repeaters 120 may transmit the data obtained by the sensors 120 physically connected to the repeater 120.

For example, a portion of the data obtained by the sensors 120 may be depth correction information. The depth correction information may be obtained at various depths of the drill string 14, such as, for example, at intervals within the borehole 30. The depth correction information may be, for example, annulus pressure, internal pressure of the drill string 14, compression, temperature, mud properties, axial stress on the drill string 14, weight-on-pipe, torque, friction on the drill string 14, bending and/or sticking. The mud properties may be, for example, a density of the mud, a viscosity of the mud, or a content of the mud. The axial stress on the drill string 14 may be, for example, compression on the drill string 14 and/or tension on the drill string 14. The term "weight-on-pipe" refers to the weight of the drill string 14 at a particular position, rather than the weight-on-bit that refers to the weight of the drill string 14 on the drill bit. For example, the weight-on-pipe may be used to determine the weight of the drill string 14 at each of the sensors 120 to aid in calculating stretch or compression of the drill string 14.

The repeaters 120 may transmit the depth correction information to the terminal 62. For example, the subset of the sensors 120 physically connected to the repeaters 120 may obtain the depth correction information, and/or each of the subset of the sensors 120 may transmit the depth correction information using a corresponding one of the repeaters 120. For example, the subset of the sensors 120 physically connected to the repeaters 120 may include strain gauges that may be embedded in the drill string 14. The strain gauges may measure the strain or stresses on the drill string 14 that may be used to correct the depth information where the strain gauge is located. For example, each of the strain gauges may measure strain on the drill string 14 at the depth at which the strain gauge is located.

Figure 3:
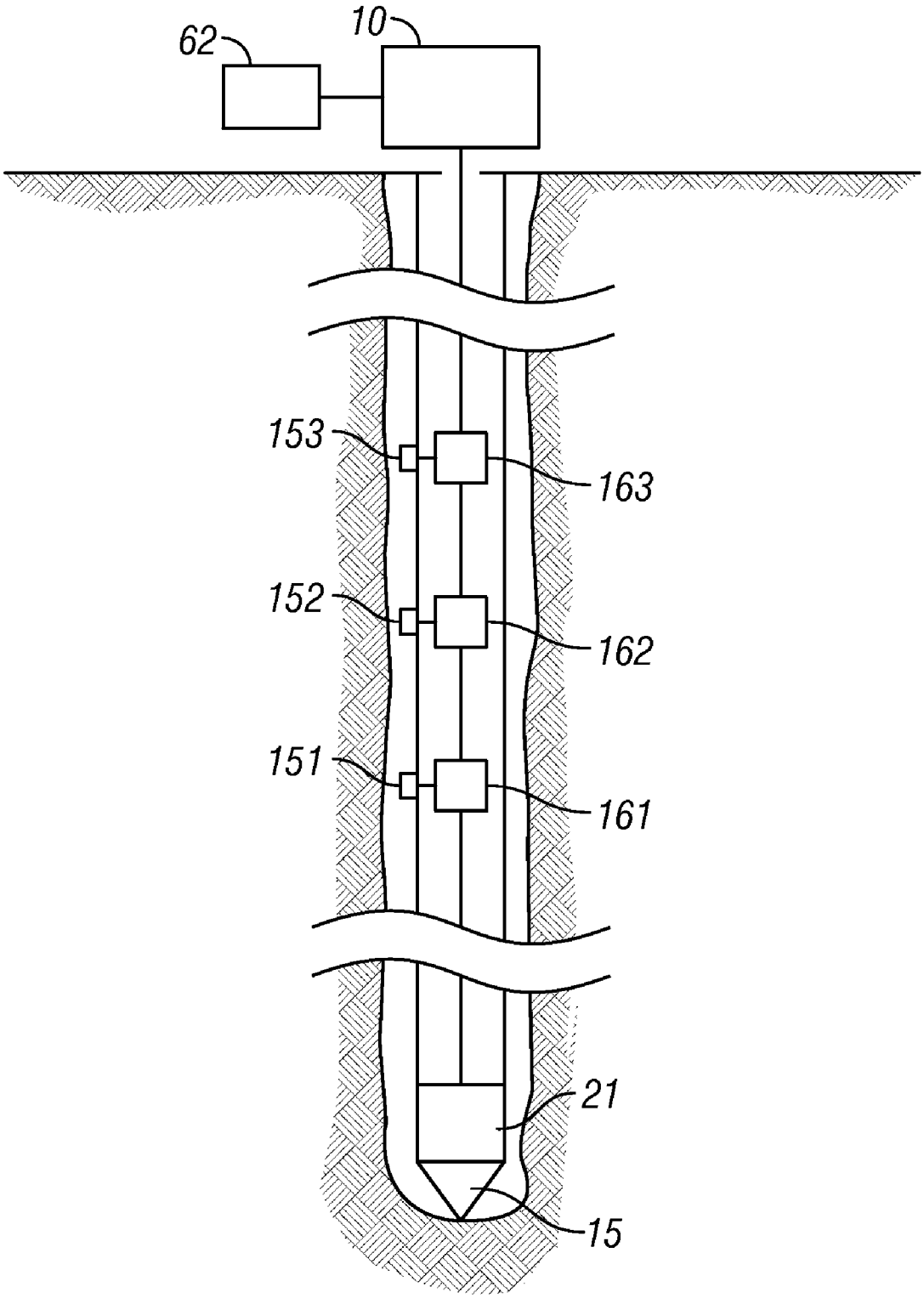
FIG. 3 illustrates wired drill pipe in an embodiment of the present invention.

For example, a first repeater 161, a second repeater 162 and a third repeater 163 may be located at different positions along the drill string 14 relative to each other as generally illustrated in FIG. 3. A first sensor 151 may be connected to the first repeater 161, a second sensor 152 may be physically connected to the second repeater 162, and/or a third sensor 153 may be physically connected to the third repeater 163. Thus, the first sensor 151, the second sensor 152 and the third sensor 153 may be located at different positions along the drill string 14 and different distances relative to each other. The first sensor 151 may obtain a first portion of the depth correction information associated with a first distance along the drill string 14, and/or the first repeater 161 may transmit the first portion of the depth correction information. The second repeater 162 may receive the first portion of the depth correction information from the first repeater 161. The second sensor 152 may obtain a second portion of the depth correction information associated with a second distance along the drill string 14, and/or the second repeater 162 may transmit the first portion and/or the second portion of the depth correction information. The third repeater 163 may receive the first portion and the second portion of the depth correction information from the second repeater 162. The third sensor 152 may obtain a third portion of the depth correction information associated with a third distance along the drill string 14, and/or the third repeater 163 may transmit the first portion, the second portion and/or the third portion of the depth correction information. The wired drill pipe 100 may transmit the first portion, the second portion and/or the third portion of the depth correction information from the third repeater 163 to the terminal 62. The depth correction information from the first distance, the second distance and/or the third distance may be used to determine the stretch of the drill string 14 as discussed in more detail hereafter. The present invention is not limited to a specific number of sensors 120, repeaters 120 or distances along the drill string 14. Any number of sensors (or tools) and repeaters may be implemented, and the depth correction information may be obtained at any number of distances along the drill string 14 or depths of the borehole 30.

Figure 4:
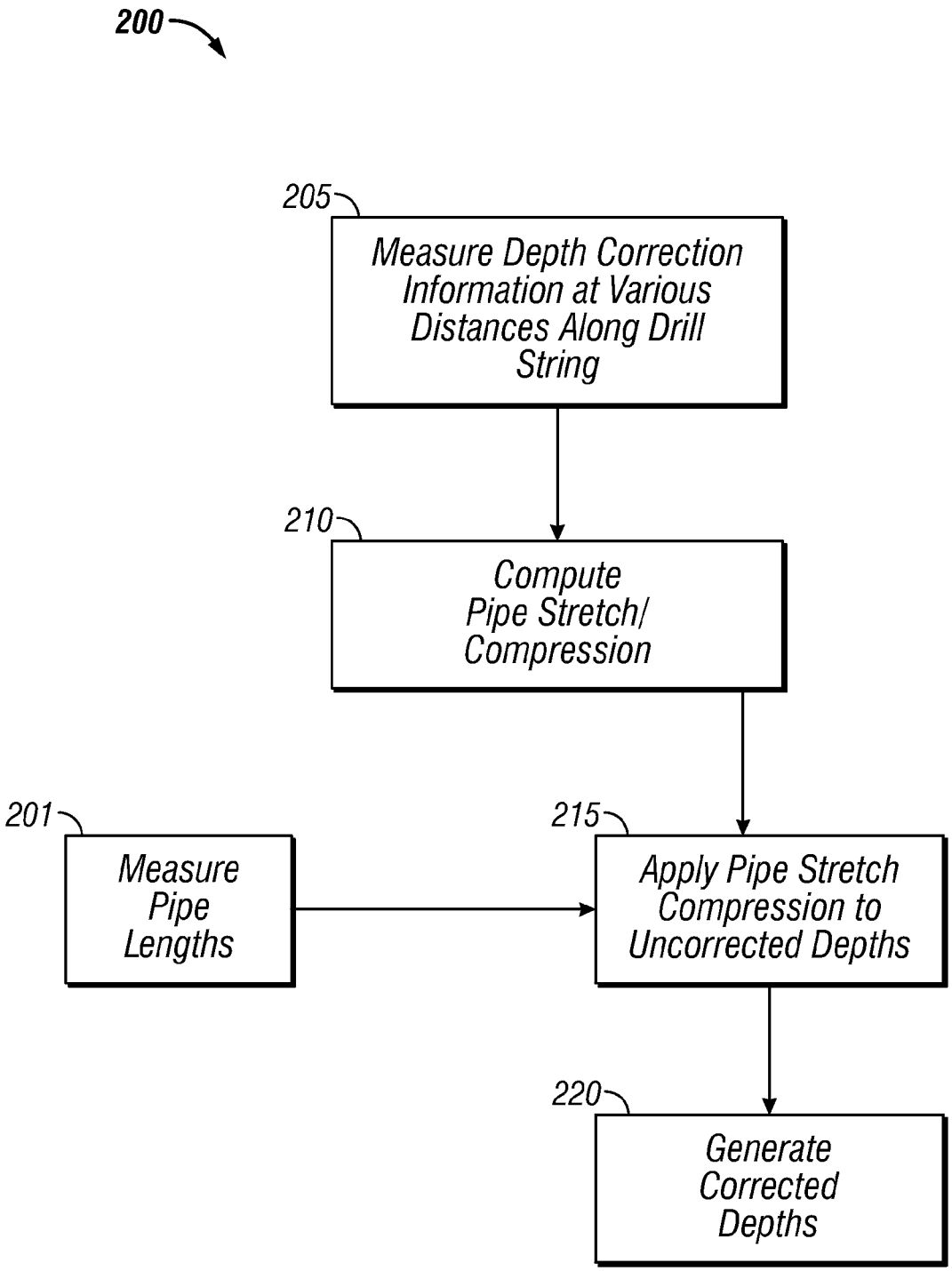
FIG. 4 illustrates a flowchart of a method for correcting error in depth for drilling measurements in an embodiment of the present invention.

FIG. 4 shows a flowchart of a method 200 for correcting depth for the data in an embodiment of the invention. The terminal 62 may associate the data obtained by the sensors 120 with corrected depths. The corrected depths may be based on the depth correction information measured at various positions along the drill string 14. The method 200 may be executed by and/or controlled by a computer readable medium, such as, for example, a database, a processor, a computer memory, a hard drive and/or the like. The computer readable medium may enable the terminal 62 to determine the corrected depths for the data.

As generally shown at step 201, a pipe length may be measured at the surface location 29 before the drill string 14 inserts into the borehole 30 and/or during insertion of the drill string 14 into the borehole 30. For example, the terminal 62 may determine and/or may record the pipe length inserted into the borehole 30 based on lengths of portions of the drill string 14 inserted into the borehole 30. The pipe length may be determined using real-time measurements obtained at the surface location 29. The pipe length may be continuously updated using the data acquired and/or transmitted in real-time. The terminal 62 may use the pipe length to generate uncorrected depths. Each of the uncorrected depths may be associated with a time. Measurements of a number or all of the sensors 120 in the drill string 14 may be synchronized, such as measured at the same time, by a command from the terminal 62 or from any of the repeaters in the drill string 14.

As generally shown at step 205, the depth correction information may be measured and/or may be determined by measurements obtained along the drill string 14. The depth correction information may be measured and/or may be determined by the sensors 120. The sensors 120 may measure and/or may obtain the depth correction information at various positions along the drill string 14. The depth correction information may be transmitted to the terminal 62 using the wired drill pipe 100.

As generally shown at step 210, the depth correction information obtained at various positions along the drill string 14 may be used to compute a pipe stretch/compression. For example, the temperature, the stress, the weight-on-pipe, the compression, the stretch, the torque and/or the bending obtained at the various distances along the drill string 14 may be used to compute the pipe stretch/compression. The terminal 62 may calculate the pipe stretch. As discussed previously, the terminal 62 may be located downhole such that the terminal 62 may be located in the borehole 30. As generally shown at step 215, the pipe stretch/compression may be applied to the uncorrected depths provided by the pipe length and/or the real-time measurements received at the surface location 29.

As generally shown at step 220, the pipe stretch/compression may be applied to the uncorrected depths to generate corrected depths. The corrected depths may be associated with times. Since the data transmitted from the tools 10 may be associated with the times the data was obtained, the times may be used to associate the data with the corrected depths. The terminal 62 may generate and/or may display a report, such as, for example, a depth log as known to one having ordinary skill in the art. The report may have and/or may display the data in association with the corrected depths. For example, the report may indicate each of the corrected depths in association with a corresponding portion of the data. In an embodiment, the terminal 62 may transmit the corrected depths to the tools 10. The tools 10 may associate the corrected depths with subsequent measurements of the data.

Using the uncorrected depths, the drill bit may be assumed to be closer to or further from the drilling surface than the actual position of the drill bit. Advantageously, using a corrected depth compensating for pipe stretch/compression along the drill string 14 yields an accurate position of the drill bit, the tools 10 and other components of the drill string 14. The tools 10 that may be connected to the sensors 120 or the repeaters 120 of the wired drill pipe 100 may obtain the depth correction information at various distances along the drill string 14. The depths and/or the corrections for the depths may be determined using the depth correction information obtained at the various distances along the drill string 14. Thus, the corrected depths may be associated with the data obtained by the tools 10 to properly allocate the data to the corrected depths. Therefore, no loss of data and no gaps in the data may be present.

It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the claims.

We claim:

1. A method comprising:

positioning a plurality of sensors at distinct positions along a drill string;

obtaining data related to stretch or compression of a drill string at the distinct positions;

transmitting the data to a terminal;

calculating stretch or compression of the drill string based on the data; and determining a length of the drill string between at least two of the plurality of sensors.

2. The method of claim 1 further comprising:

calculating a corrected depth for at least one of the plurality of sensors in the drill string, wherein the corrected depth is based on the data and compensates for the stretch or compression of the drill string.

3. The method of claim 2 further comprising:

positioning tools on the drill string capable of obtaining measurements related to the drill string or formation surrounding the drill string; and associating the measurements with the corrected depth.

4. The method of claim 1 further comprising:

transmitting a weight-on-pipe measured at two or more of the distinct positions along the drill string to the terminal using the wired drill pipe wherein the stretch or compression of the drill string is based at least partially on the weight-on-pipe measured at the two or more distinct positions.

5. The method of claim 1 further comprising:

measuring lengths of portions of the drill string prior to insertion of the drill string into a wellbore wherein the stretch or compression of the drill string is based at least partially on the lengths of the portions of the drill string.

6. The method of claim 1 wherein the drill string at least partially comprises wired drill pipe and at least one of the sensors is incorporated into to a repeater, the repeater adapted to amplify signals transmitted along the wired drill pipe.

7. The method of claim 1 wherein the stretch or compression of the drill string is based at least partially on temperature.

8. The method of claim 1 wherein the data is continuously collected by the plurality of sensors and is used to continuously compute the stretch or compression of the drill string to correct a depth of the sensors in the drill string.

9. A system for using a terminal to correct for depth errors related to a drill string in a wellbore, the system comprising:

a drill string comprising at least a portion of wired drill pipe extending within the wellbore, the wired drill pipe communicatively coupled at each pipe joint;

a plurality of sensors connected to the wired drill pipe and adapted to collect data for determining stretch or compression of the drill string, the plurality of sensors positioned along the drill string; and at least one repeater associated with the wired drill pipe capable of amplifying signals transmitted along the wired drill pipe wherein each at least one repeater transmits the data via the wired drill pipe and further wherein at least one of the sensors is incorporated into the at least one repeater.

10. The system of claim 9 further comprising a terminal in communication with the wired drill pipe, wherein the terminal receives the data and determines stretch or compression of the drill string based on the data.

11. The system of claim 10 wherein the terminal is positioned within the wellbore.

12. The system of claim 10 wherein the terminal calculates a corrected depth for at least one of the plurality of sensors in the drill string, wherein the corrected depth is based on the data and compensates for the stretch or compression of the drill string.

13. The system of claim 12 further comprising:

tools positioned within the drill string, the tools capable of obtaining measurements related to the drill string or formation surrounding the drill string, wherein the terminal is adapted to associate the measurements with the corrected depth.

14. The system of claim 9 wherein at least one of the sensors obtains the data via strain gauges that measure stress on the drill string.

15. The system of claim 9 further comprising a terminal in communication with the wired drill pipe and adapted to receive the data, wherein the terminal analyzes the data to determine the stretch or compression of the drill string and calculates a corrected depth of the drill string.

16. A method comprising:

positioning a plurality of sensors at positions along a drill string within a wellbore, the drill string at least partially comprising a plurality of wired drill pipe joints communicatively coupled;

determining a depth of the drill string;

obtaining data related to stretch or compression of the drill string;

transmitting the data to a terminal;

determining stretch or compression of the drill string between each of the plurality of sensors; and calculating a corrected depth of the drill string compensating for the stretch or the compression of the drill string.

17. The method of claim 16 further comprising:

positioning tools on the drill string;

obtaining a measurement of a formation surrounding the drill string; and associating the measurement with the corrected depth.

18. The method of claim 15 further comprising:

processing the data via the sensors to determine the stretch or the compression within the wellbore and compute corrected depth of the drill string.

19. The method of claim 15 further comprising:

generating a plot of the data versus depths based on the stretch or compression wherein the terminal generates the plot.

* * * * *